United States Patent [19]

Suttner

[11] Patent Number: 4,880,166

[45] Date of Patent: Nov. 14, 1989

[54] VALVE PISTOL FOR A HIGH PRESSURE CLEANING DEVICE

[76] Inventor: Wolfgang Suttner, Dunlopstrasse 21, 4800 Bielefeld 11, Fed. Rep. of Germany

[21] Appl. No.: 150,210

[22] Filed: Jan. 29, 1988

[30] Foreign Application Priority Data

Jan. 29, 1987 [DE] Fed. Rep. of Germany ..... 3702586
Jun. 19, 1987 [DE] Fed. Rep. of Germany ..... 3720241

[51] Int. Cl.[4] ..... B05B 7/02; B05B 1/30; B05B 1/14

[52] U.S. Cl. ..... 239/526; 239/583; 239/590

[58] Field of Search ..... 239/525–527, 239/530, 532, 288, 590, 480, 583; 222/146.2, 473–475

[56] References Cited

U.S. PATENT DOCUMENTS

| | | | |
|---|---|---|---|
| 1,551,439 | 8/1925 | Stoms | 239/583 X |
| 2,416,719 | 3/1947 | Stockdale | 239/480 |
| 3,861,596 | 1/1975 | Nathan et al. | 239/583 X |
| 4,071,195 | 1/1978 | Kuhns et al. | 239/436 X |
| 4,083,497 | 4/1978 | Rosenberger | 239/526 |
| 4,166,579 | 9/1979 | Beise et al. | 239/526 |
| 4,651,929 | 3/1987 | Kränzle | 239/288 |
| 4,755,073 | 7/1988 | Girardin | 222/146.2 X |
| 4,776,517 | 10/1988 | Heren | 239/526 X |
| 4,798,934 | 1/1989 | Boyer | 219/233 |

FOREIGN PATENT DOCUMENTS

| | | | |
|---|---|---|---|
| 3209902 | 9/1983 | Fed. Rep. of Germany . | |
| 3301768 | 7/1984 | Fed. Rep. of Germany . | |
| 622632 | 6/1927 | France | 239/583 |
| 2495022 | 6/1982 | France | 239/526 |
| 1160204 | 8/1969 | United Kingdom | 239/526 |

*Primary Examiner*—Andres Kashnikow
*Assistant Examiner*—Patrick N. Burkhart
*Attorney, Agent, or Firm*—Sixbey, Friedman, Leedom & Ferguson

[57] ABSTRACT

A valve pistol for a high pressure cleaning device with a pistol casing (10), a valve (17) with a stopper element (25) placed in the pistol casing (10), pipe sections (14, 15) for fluid supply to and discharge from said valve located in the pistol casing (10), a hand lever (11) supported in the pistol casing (10) and acting on the stopper element (25) of valve (17), and in which both pipe sections (14, 15) are placed at an angle to each other, preferably an obtuse angle, is considerably simplified structurally and simultaneously improved with respect to safety and handling by both pipe sections (14, 15) being constructed as one piece angular pipe (13). A valve (17) is placed in the interior of a pipe section (14 or 15), preferably in the fluid supply pipe section (14), and one of the pipe sections (14 or 15) has an opening (23) for the passage of an actuation element (24) for the stopper element (25) of the valve (17).

20 Claims, 6 Drawing Sheets

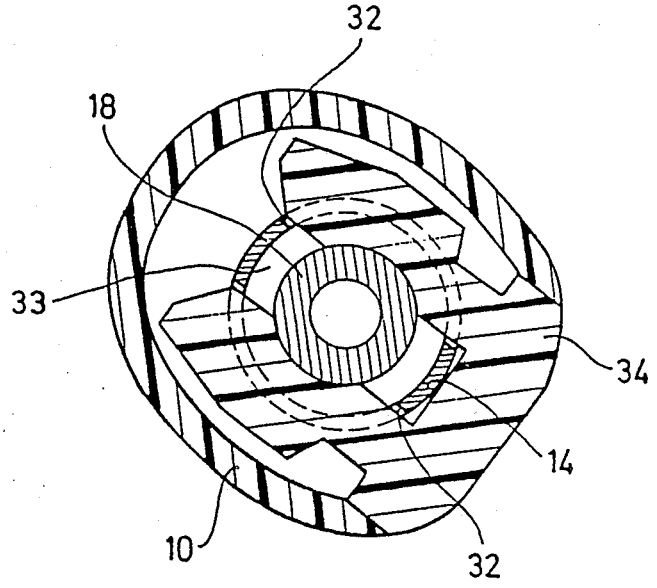
Fig.3
Fig.2
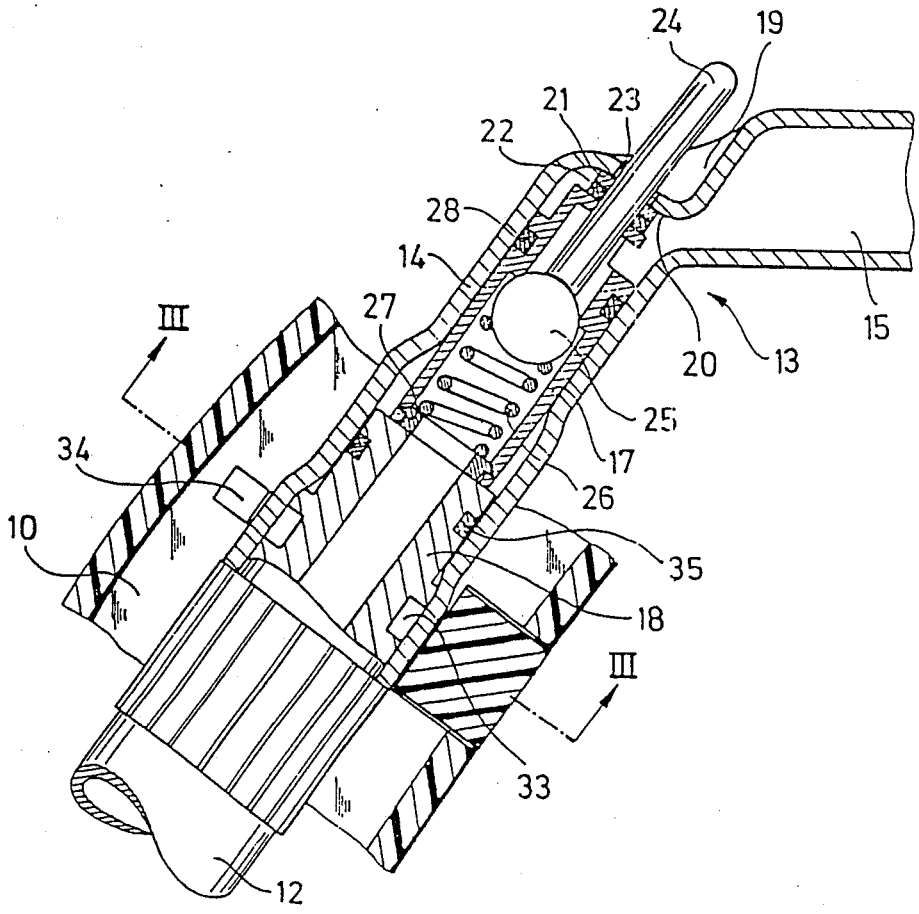

VALVE PISTOL FOR A HIGH PRESSURE CLEANING DEVICE

BACKGROUND OF THE INVENTION

1. Field of the Invention

The present invention relates to pistol valves, particularly those as used in high pressure cleaning devices and which have a casing with a pistol-like configuration and a hand-operated triggering lever for acting on a stopper valve element.

2. Description of Related Art

A known valve pistol of the above-mentioned type is disclosed in German Offenlegungsschrift Nos. 33 01 768 and 32 09 902. The known valve is constructed of a total of four parts. The core of this valve pistol is a metal valve which is made as a turned part or a cast part and contains all components essential for the valve function of the valve pistol. At the fluid inlet and fluid outlet of the valve casing there is a threaded socket into each of which an individual pipe section can be screwed. The casing of the known valve pistol consists preferably of heat insulating material, especially plastic, and is usually constructed either of two half shells or one piece, over which a casing cover is disposed, the casing cover being openable to make it possible to reach the valve casing inside the pistol casing.

SUMMARY OF THE INVENTION

The primary object of the present invention is to considerably simplify the above-noted type of known valve pistol from a structural standpoint while, simultaneously, improving it from the standpoint of safety and operation.

The noted object of the invention is achieved by providing a valve pistol wherein the valve is disposed within a one-piece angular fluid supply pipe that has an opening for the passage of an actuation element for the stopper element of the valve. According to the invention, the previously required, expensive and heavy valve casing made of cast material is completely eliminated since a section of the fluid supply pipe, preferably the pipe section on the high pressure side, is used as the mounting for the valve. Of course, a structural adaption of the valve to the cylindrical shape of the mounting in the pipe section is necessary, but such an adaptation is made relatively easily. The essential thing is only that the actuation element for the stopper of the valve must somehow be led to the outside, to enable it to interact with the hand lever on the pistol casing. This gives rise to the possibility of constructing both pipe sections as one piece, thus designing them as a continuous pipe. A seamless, straight pipe, can be the starting material with an angular arrangement of the pipe sections being easily achieved for the pipe by cold forming or, with certain materials, by hot forming. As materials for the pipe, high-grade steel, brass, aluminum, as well as pressure-resistant plastics are suitable. The material choice essentially depends on the pressure range in which the valve pistol is to be used and on the nature of the fluids to be processed with the valve pistol.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 2 is an enlarged view showing a segment of FIG. 1 in the area of the valve of the valve pistol;

FIG. 3 is a sectional view taken along line III—III of FIG. 2;

DETAILED DESCRIPTION OF THE PREFERRED EMBODIMENTS

Figure 1:
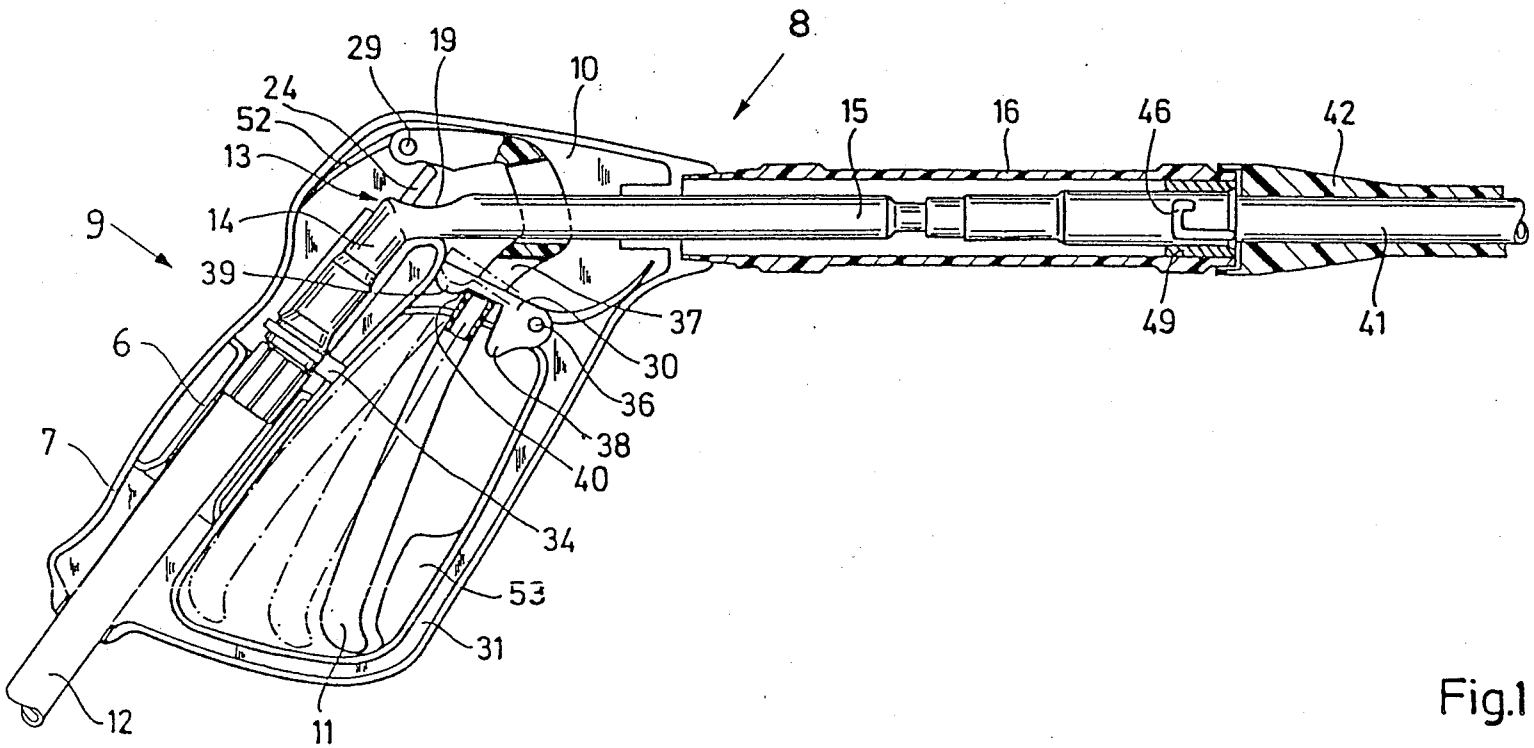
FIG. 1 is a partial longitudinal sectional view, with the pistol casing open, of a first embodiment of a valve pistol according to the invention.

The valve pistol of the various embodiments of the invention is intended for a high-pressure cleaning device as is used, for example, at service stations or garages for cleaning motor vehicles as well as more and more widely, privately, for hobbies. This valve pistol has a pistol casing 10 which, in the preferred embodiments, is made of a heat insulating material, especially of a plastic, and which may be constructed from two half shells or can be made of one piece.

A valve 17, shown most clearly in FIG. 2, is placed in pistol casing 10. Valve 17, as is known in the art, has a stopper element 25 disposed in a valve chamber and is in the form of a ball which seats against a valve seat under the action of a pressure spring 26 that applies pressure to the stopper element 25 in a valve closing direction. In a way also known in the art, pressure spring 26 is braced on a backup ring 27 that is permanently attached to valve 17; this backup ring 27 thus forms, to a certain extent, the support for pressure spring 26. On the side of stopper element 25 facing away from pressure spring 26, an actuation element 24, here constructed in the form of a plunger rod extending into the interior of valve 17, engages stopper element 25 in a way known, per se, in the art.

In addition, pipe sections 14, 15 are used for fluid supply to valve 17 and fluid discharge from valve 17, respectively, and are placed in pistol casing 10. Fluid supply pipe section 14 is used for the connection of a feed pipe 12, or the like, that is used for the supply of fluid in a high-pressure resistant manner, while pipe section 15 is connected, for fluid discharge, with a spray lance 41, or the like, to be explained later. To connect feed pipe 12 and, optionally spray lance 41, pipe connections 9, 8 can be provided as is known in the art. These pipe connections 9, 8, as is known in the prior art, can be constructed as screw pipe connections, but further, preferred, designs for these pipe connections 9,8 will be explained below in more detail.

To actuate valve 17, a trigger-like hand lever 11 is movably supported in pistol casing 10 and acts, through actuation element 24, on stopper element 25 of valve 17. Like pistol casing 10, this hand lever 11 is preferably formed of a heat insulating material, especially plastic.

In the embodiments shown here, as is known from the prior art, both pipe sections 14, 15 are placed at an angle relative to each other, preferably at an obtuse angle, especially an angle of about 135°. This corresponds to the usual ergonomic special features of a valve pistol of the kind being discussed. In addition, pipe section 15 that is used for fluid discharge is, in the embodiment shown in FIG. 1, extended out of the pistol casing 10 and is surrounded in the area outside pistol casing 10 by a protective pipe 16 of a type known in the art which is, likewise, preferably made of a heat insulating material and can act as an additional handle.

First of all, as shown in FIGS. 1, 2, 4, and 7, according to the teaching of the invention, the pipe sections 14, 15 (which are separate parts in the prior art) are constructed as one piece. Thus, in the particular case here, they are designed as a single continuous angular pipe 13. The specific angular pipe 13 shown in the drawings was made from a continuous, straight pipe section by cold forming techniques which, from a production engineering point of view, are conventional. Thus, three parts of the known valve pistol (pipe sections 14, 15 and the valve casing placed in between them) are integrated into a single part, namely the continuous, one-piece angular pipe 13. With regard to the valve, valve 17 is placed in the interior of one of pipe sections 14, 15 of angular pipe 13, preferably in fluid supply pipe section 14. Actuation element 24 for stopper element 25 of valve 17 must now, of course, be guided out of pipe section 14 or 15, so that pipe section 14 or 15 consequently must have an opening 23 for the passage of actuation element 24. The embodiment shown in FIG. 1 provides a hole which is coaxial to pipe section 14 but which, itself, strictly speaking, is placed in pipe section 15. On the other hand, in the embodiment according to FIG. 7, a hole that is coaxial to pipe section 14 is placed in pipe section 14 itself. Theoretically, the opening could also be the open end of one of the pipe sections.

In the way explained above, a largely integrated, structurally extremely simple, valve pistol is made which is very advantageous, not only from a production engineering viewpoint due to the elimination of a heavy cast part for the valve casing resulting from this function being taken over by the supply pipe 13, but also advantages are achieved from a safety viewpoint. That is, the elimination of a multiplicity of screw connections prevents such screw connections from being able to come loose during operation, so that there will be hardly any leaks in operation.

Figure 7:
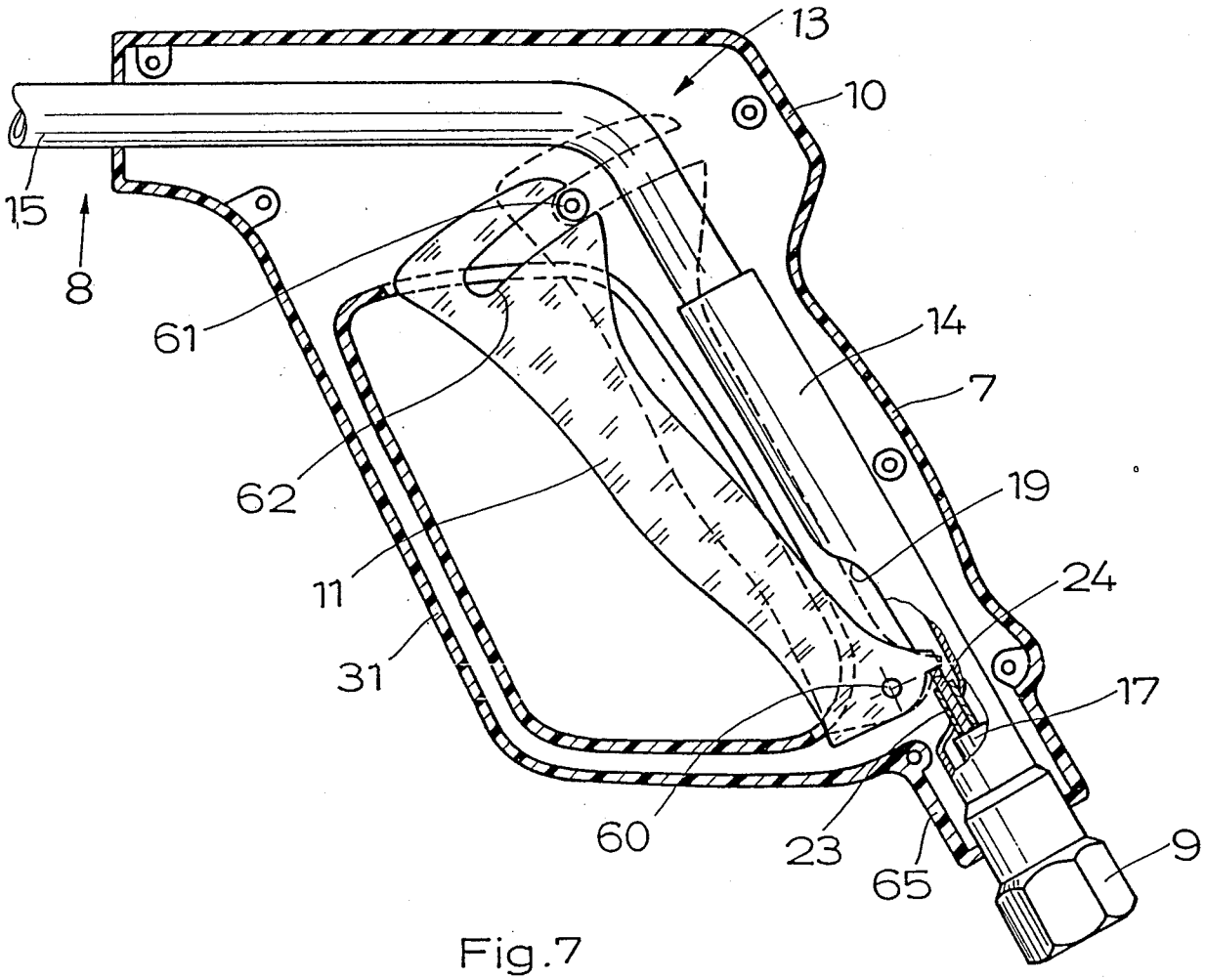
FIG. 7 is a partial sectional view of the valve pistol from FIG. 6.

For the embodiments of FIGS. 1, 2 and 7, valve 17 is constructed as a unit that is inserted into pipe 13 from one end of receiving pipe section 14. Actuation element 24 projects like a pin out of the body of the valve unit and through opening 23 in pipe section 14 or 15, or projects from outside of the pipe section, through the opening into the insert body. Valve 17 is preferably constructed as a circular cylindrical insert unit so that it can be inserted from the open end of pipe section 14 into the pipe section and so that the entire valve 17 can be exchanged, in a simple way, in case it should become damaged due to the very rough operating conditions to which valve pistols of the kind being discussed are often subjected.

Up to now, nothing has been said as to where and how opening 23 for the passing through of actuation element 24 can be placed or attached in pipe section 14 or 15. An opening in pipe section 14 or 15 that is solely radially oriented would certainly be practical from a production engineering standpoint and would need, in fact, only one stamping operation for its production. However, use of a radial opening would necessitate the use of a transmission mechanism (which is sometimes a bit too expensive) for transmitting movement of actuation element 24 to stopper element 25. To provide an axially oriented surface for opening 23, according to a further and preferred teaching of the invention, bordering valve 17, pipe section 14 or 15 is provided with an indentation 19 or other reduction of its cross section, so that opening 23 can be placed on a wall of indentation 19 facing valve 17, preferably in a front wall 20 that is oriented approximately perpendicular to the longitudinal axis of pipe section 14. A part of actuation element 14 is located in the free space created by indentation 19. Such an indentation 19 can be made easily by hot forming or cold forming, especially by press forming, in a pipe that, itself, is elongated and, for example, drawn seamless, as has been recognized according to the invention. In this way, from a production engineering standpoint, this indentation 19 can also be made so that no problems arise from a safety engineering standpoint, specifically the seamless, continuous guidance of the medium under flowing high pressure remains unimpeded in angular pipe 13.

In the embodiment shown in FIGS. 1 and 3, indentation 19 is placed in the angular pipe 13 at the outer side of the angle. Here the section, which must be deformed anyway by the angular bending of the continuous pipe, is used for the simultaneous formation of indentation 19. This has the further advantage that the free end of actuation element 24 projects laterally outward above pipe section 15 without any additional measures having to be taken and, thus, another actuation element connected with hand lever 11 can engage there easily. The position of this free end above pipe section 15 provides the possibility of supporting hand lever 11 so that it pivots around a rotational axis 29, which lies very close to actuation element 24, but is very far from the point of contact of the operator's hand. Thus a large lever arm can be achieved for the hand lever, which is advantageous from the standpoint of operating engineering.

In the embodiment shown in FIG. 7, valve 17 is placed in pipe section 14' near a pipe connection 9', which optionally projects outward from pistol casing 10'. In this case indentation 19' is placed in pipe section 14', preferably on the side of valve 17 facing away from pipe connection 9'. Here, oriented in the longitudinal direction of pipe section 14', this indentation 19' has a tub-like shape in which an actuation element connected to hand lever 11' can engage laterally. This construction will be explained in further detail later.

As in the prior art, in all of the embodiments, pipe section 14, 14' is provided with a pipe connection 9, 9' for connection to an external feed pipe 12 or the like, as has been indicated above. However, in accordance with a preferred embodiment, the pipe section 14 is widened in steps to form pipe connection 9. With modern production engineering methods, such a widening can be produced by cod forming. In doing so, a graduated widening to various diameters can occur so that, coaxial to pipe section 14, circumferential contact surfaces result that can be used for various purposes. For the connection with feed pipe 12, a connecting piece 18 (FIG. 2) is provided which is permanently attached to the feed pipe and can easily be inserted into this widened portion of pipe section 14.

From the structure that is clearly recognizable in FIG. 2, it can be appreciated that the valve 17 is first inserted into pipe section 14 until it contacts front wall 20, and then connection piece 18, with feed pipe 12 located on it, is inserted. The placement of valve 17 against front wall 20 occurs through a placement ring 21 on which a gasket ring 22 is braced. Placement ring 21 and gasket ring 22 each exhibit a centered opening for the passage of plunger rod actuation element 24, and are, thus, centered automatically by actuation element 24 on opening 23 in indentation 19 of angular pipe 13. Connecting piece 18 holds the valve in the interior of pipe section 14 and gasket ring 28 of valve 17 and 35 of connecting piece 18 assure that the fluid on the high pressure side of valve 17 cannot flow around and past them into pipe section 15.

Axial pressure on the plunger rod actuation element 24 presses the ball stopper element 25 in FIG. 2, downward countering the spring force of compression spring 26 and, thus, opens a flow passage from pipe section 14 into pipe section 15. If hand lever 11 is released, compression spring 26 causes an immediate closing of valve 17 in that stopper element 25 is pressed onto a valve seat. Compression spring 26 is sufficiently large in size so that it can simultaneously push actuation element 24 back, thereby returning hand lever 11 into its starting position. The hand lever can be locked in its starting position by a pivotable safety catch 30 on the valve pistol, as is known in the art and will be explained later in an especially preferred embodiment. Hand lever 11 is, in the embodiment shown in FIG. 1, surrounded by a hoop guard 31 on which a limit stop 53 is provided that is designed so that the surface of hand lever 11 that can be grasped by the hand of an operator is considerably smaller and closer to the pivot point of the lever in the starting position (solid lines) than in depressed positions (dot-dash lines). As a result, for the initial depressing of hand lever 11, an especially high power is necessary, after which the hand may be slid to a position reducing the force required to hold and/or further depress lever 11. As a result, a special safeguard against unintentional operation of hand lever 11 is provided.

Returning to the attachment of valve 17 in the interior of pipe section 14, FIG. 2 shows an especially preferred characterizic in that connecting piece 18 has an annular slot 33 and pipe section 14 has inserting slots 32 that are aligned with annular slot 33. Thus, the legs of a somewhat U-shaped clamp 34 can be inserted into inserting slots 32 and annular slot 33. This attachment technique guarantees a detachable attachment of feed pipe 12 in an especially simple way, while producing the additional special advantage in that no mechanically stressful turning movements must be conducted for the attachment. In fact, feed pipe 12, together with pipe section 14, remain free to turn around their common longitudinal axis, despite being permanently attached in the direction of their longitudinal axis against axial shifting of connecting piece 18 in relation to pipe section 14 by clamp 34. In the embodiment shown, pistol casing 10 has an opening for insertion of clamp 34 and clamp 34 has a widened head section which completely closes the opening when clamp 34 is inserted. Further, it is suitable that clamp 34 consists, at least in the head section, of a heat insulating material, especially plastic.

A preferred aspect of this embodiment is that head section clamp 34 is matched to pistol casing 10 so that it effectively seals the pistol casing but is simultaneously accessible from the outside. The connection between feed pipe 12 and pipe section 14, thus, can be detached from the outside without having to open pistol casing 10. Therefore, to exchange valve 17, only clamp 34 need be removed radially from pipe section 14 so that, then, connection piece 18 can be pulled out, and valve 17 then removed.

FIG. 3 shows especially clearly the preferred clamp technique of the invention explained above. Here it can be seen that in the area of the elastically flexible legs of the clamp 34, arcuate internal surfaces are provided so that legs of the U shape clip onto and against connecting piece 18 and, thus, the clamp 34 is fastened against pistol casing 10 without a chance of becoming lost. The clamp technique explained above also means that the wall strength of pipe sections 14, 15 can be relatively low since threads no longer need to be applied. As a result, this technique is relevant, to a very special degree, to high pressure cleaning devices used in middle pressure ranges, i.e., especially as used by hobbyists, because with a low cost expenditure, a sufficiently reliable, stable structure is achieved whose cost is matched to the intended application.

From a safety engineering viewpoint, FIG. 1 shows another very particular preferred feature that is especially distinguished in that the coupling section for feed pipe 12, thus for the high pressure side, is placed deeply sunk into the interior of pistol casing 10. For this purpose, pipe connection 9 of fluid supply pipe section 14 is set back into the interior of pistol casing 10. This setback arrangement can be achieved, especially suitably, if the freely-turnable plug connection, explained above, is made with U-shaped clamp 34, etc. To facilitate the connection of a feed pipe 12 by an operator, it is recommended that pistol casing 10 exhibit a slide-in guide 6 for the end of feed pipe 12 that is to be pushed in. This is particularly suitable if, as is often provided in middle pressure range applications of valve pistols of the type being discussed, feed pipe 12 is a flexible hose line. But, for the professional range of the application of valve pistols of the type being discussed, thus ranges where especially high pressures of the flowing medium and/or especially high strain will occur, a screw connection of the type explained in the embodiment according to FIGS. 6 and 7, which is known, per se, from the prior art, is preferably recommended.

Turning now to fluid discharge pipe section 15, it is especially suitable if, as shown in FIG. 7, pipe section 15 is extended to form an integrated, elongated spray lance 41. This is especially advisable if, as for example in the hobbyist sphere, an existing kind of spray lance is used on which only the spray nozzle placed on the discharge end is exchanged. This kind of integrated spray lance 41 is, of course, especially advantageous from a cost viewpoint.

If, for example, in the professional sphere, it is desired to work with an exchangeable spray lance 41, it is known in the prior art to provide fluid discharge pipe section 15 with a pipe connection 8, preferably, projecting from pistol casing 10 for the attachment of an external spray lance 41 or the like. In this respect, in the embodiments shown in FIGS. 1, 4 and 5 it applies that, according to the preferred teaching of the invention, pipe section 15 can be widened in steps in the same manner as has already been explained for pipe section 14. In doing so, it is especially suitable to equip the end of pipe section 15 with a coupling, especially a part of a quarter turn, bayonet-type catch 46. Such a coupling technique is especially suitable for use with middle pressure range application valve pistols of the type being discussed. A quarter turn catch 46 which can be actuated quickly and structurally is quite simple to produce.

Suitably, the inlet end of spray lance 41 is constructed as a counterpart to the part of quarter turn catch 46 on pipe section 15. For this purpose, according to a preferred teaching of the invention, pipe section 15 has angular, quarter turn, spherically rounded indentations 47 and spray lance 41 has catch pins 48 that enter indentations 47. This structure and distribution of the fastening elements on the structural parts involved prevent the wall strength of spray lance 41 from being weakened by the quarter turn indentations 47.

Figure 5:
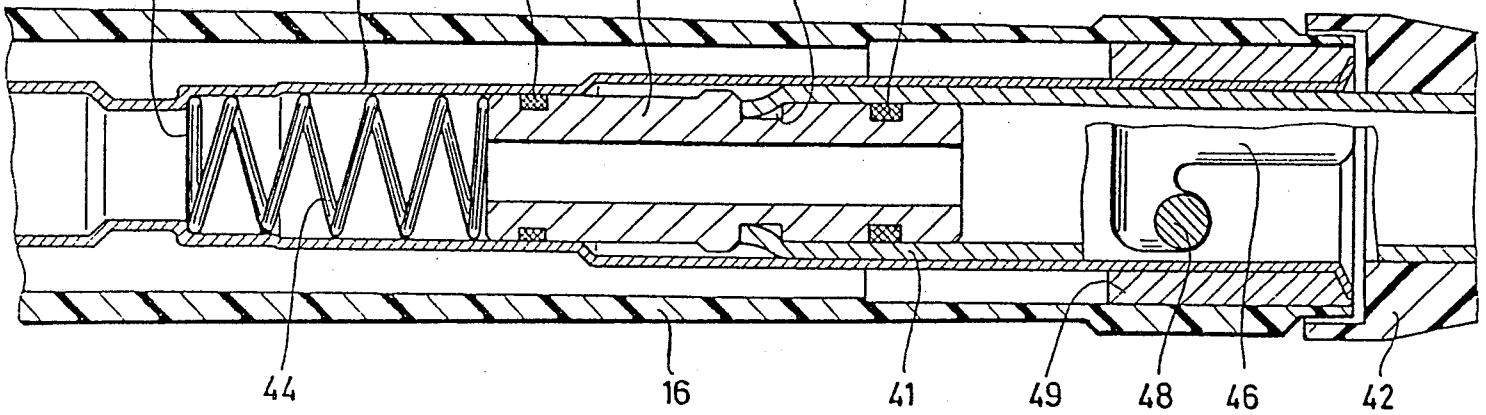
FIG. 5 is a highly enlarged view showing the area of a quarter-turn fastener on the end of the valve pistol on the low pressure side in FIG. 1.
Figure 4:
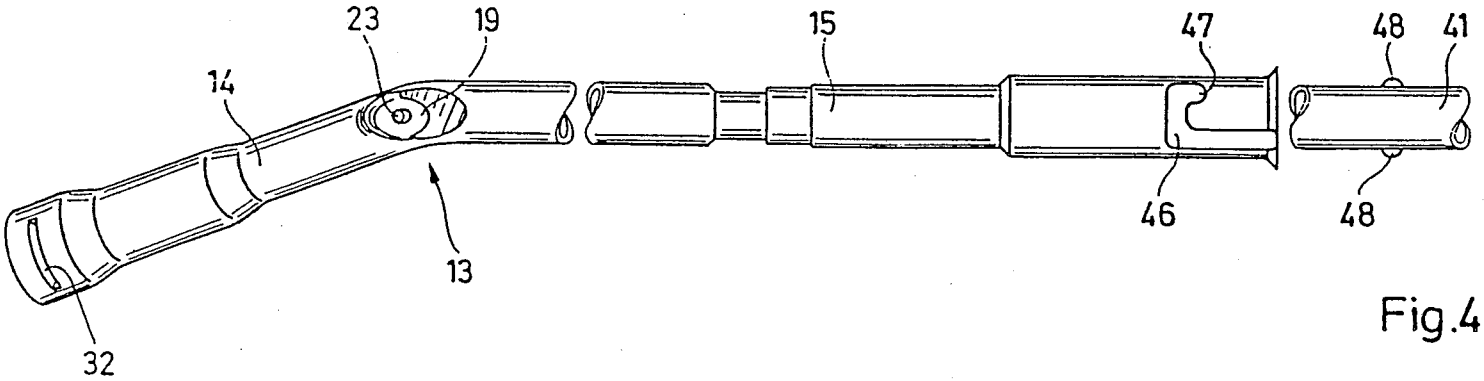
FIG. 4 is a diagrammatic illustration of the angular pipe of the valve pistol of FIG. 1.

In the embodiment shown in FIG. 1, it can be seen that spray lance 41 is surrounded, along most of its length, by a protective covering 42, made of heat insulating material, so that an operator will not be injured by contact with a hot surface of spray lance 41 as might otherwise occur, with the use of hot water. It can also be seen that pipe section 15 is widened to various diameters in steps over quite a long length, and that spray lance 41 can be inserted relatively far into the interior of pipe section 15 (FIG. 5). This is necessary so that the deadweight of spray lance 41 cannot lead to it snapping off.

As shown in FIG. 5, because pipe section 15 is widened in various sections to different diameters, this results in a ring-shaped stopping edge 43 being created on which a pressure spring 44 can be axially braced in pipe section 15. Pressure spring 44 is used to lock the catch pins 48 of spray lance 41 in the quarter turn indentations 47 of quarter turn catch 46. In the embodiment shown, an inner portion of the length of pressure spring 44 is securely held by the interior surface of one stepped portion of pipe section 15 so that it cannot easily fall forward out of pipe section 15. After the engaging of quarter turn catch 46, an inadvertent turning back of spray lance 41 is prevented by the J-shaped angular form of quarter turn indentations 47 which provide a notch-like end in which pin 48 may be held under the force of spring 44 and from which it can be removed by overcoming that force.

The end of spray lance 41 that is constructed as a part of the quarter turn catch 46 is provided with a connecting piece 45 which, itself, lies axially adjacent to pressure spring 44, as shown in FIG. 5. A circumferential annular slot 50 is formed in connecting piece 45 for rolling in an end of spray lance 41. In addition, two circumferential annular slots are provided for annular gasket rings 51, one of which creates a sealing action relative to the interior surface of pipe section 15 and the other of which creates a sealing action relative to the interior surface of spray lance 41 so that, overall, a sealed fluid flow is possible through connecting piece 45. This plug connection is an especially suitable construction for the middle pressure range; however, in certain cases it may be desirable to have annular slots for gasket rings also placed on the spray lance.

Further, it is also possible to make the whole arrangement such that the pipe section is not widened in steps to various diameters, but rather is of a constant diameter throughout In such a case, the spray lance could be inserted up to the bend in the pipe section and it would only have to be made certain that a compression spring arrangement, corresponding to that achieved via spring 44, is present on the spray lance for the action of the quarter turn catch.

A further feature shown in FIGS. 1 and 5 is that a spacing sleeve is disposed on the end of pipe section 15 and which separates the protective pipe 16 made of heat insulating material from pipe section 15. Thus, further heat insulation of protective pipe 16 occurs from the dead-air space created between protective pipe 16 and pipe section 15.

Figure 6:
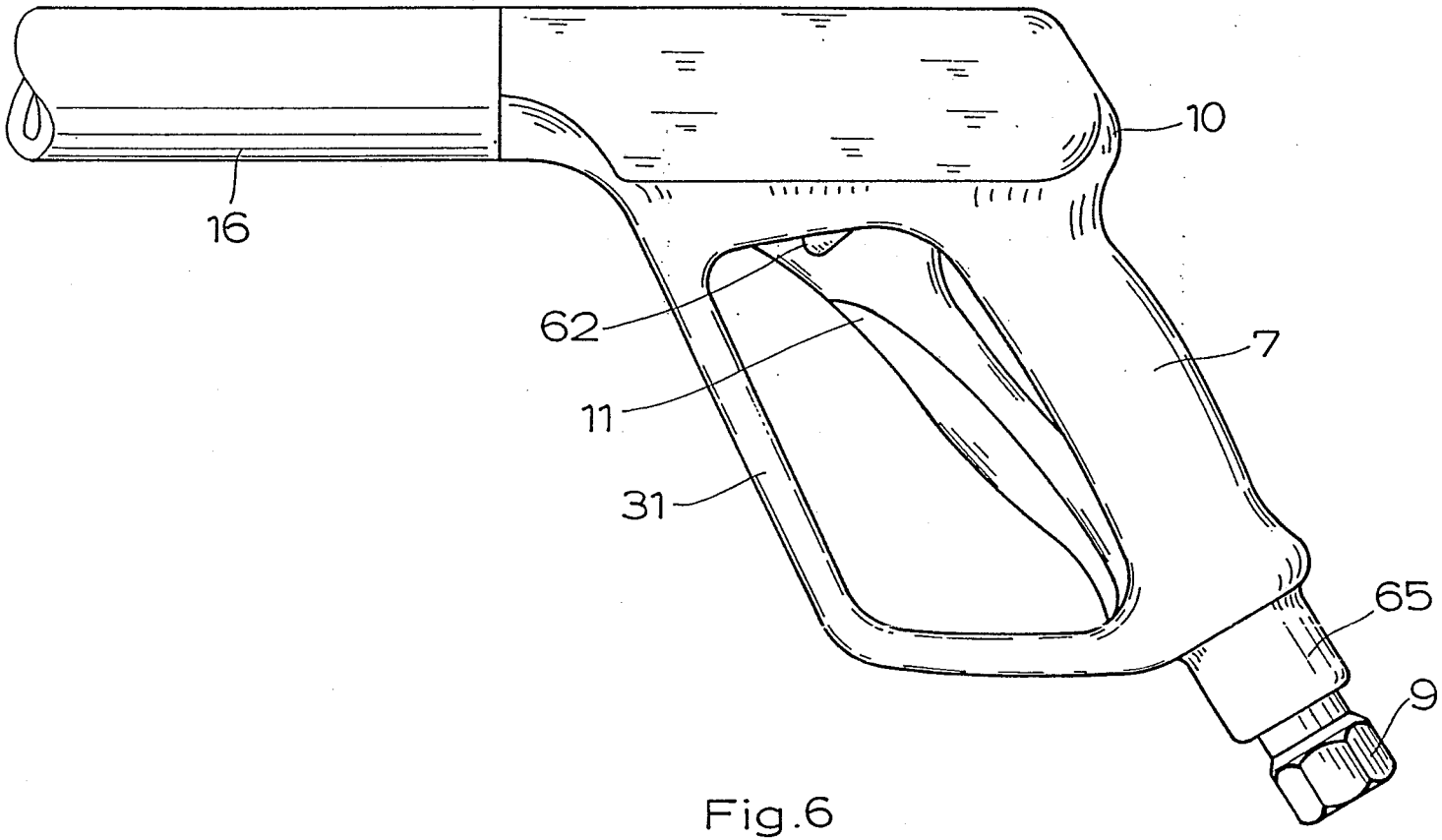
FIG. 6 is a side elevational view of a further, especially preferred embodiment, of a valve pistol.
Figure 8:
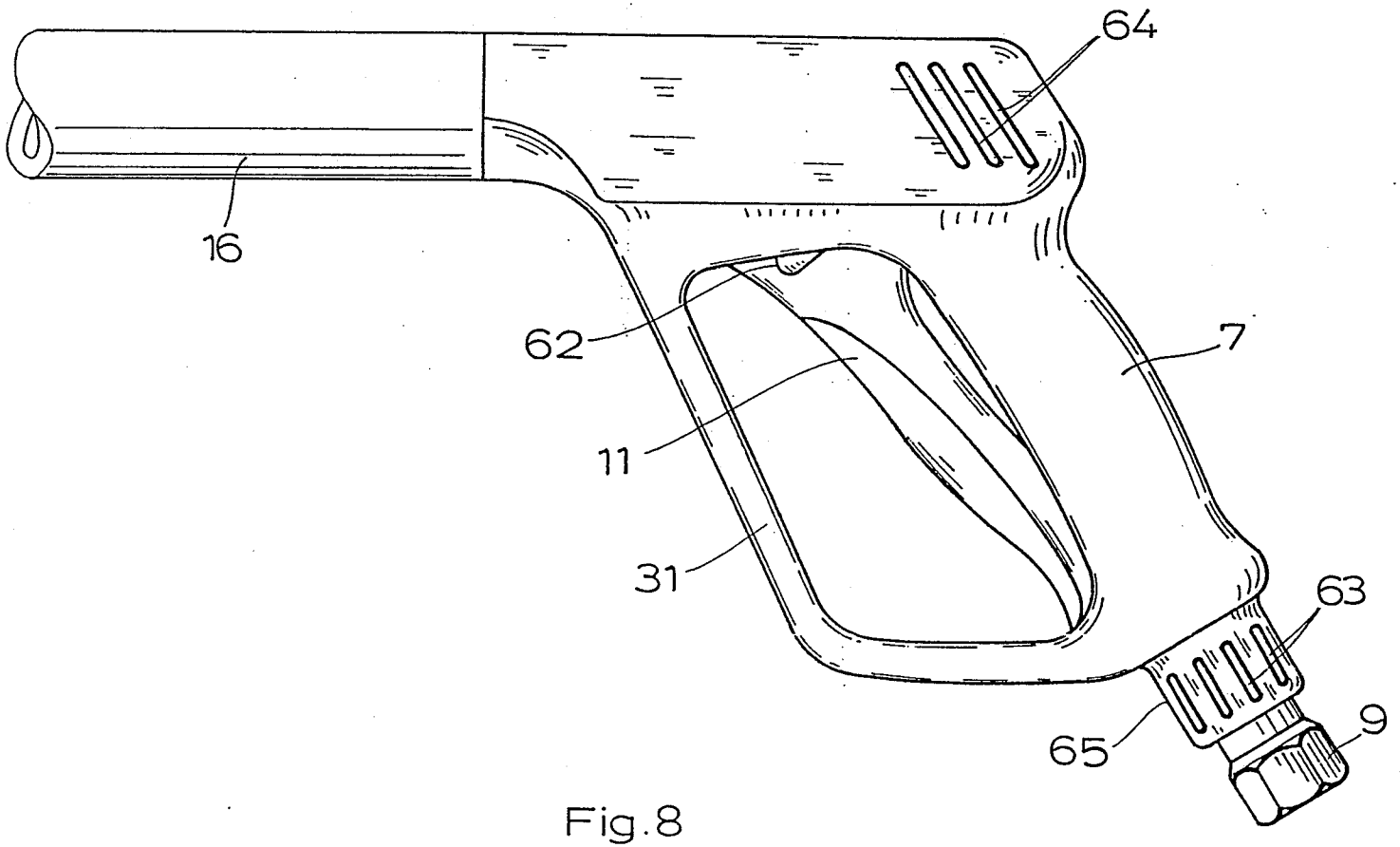
FIG. 8 illustrates a valve pistol according to the embodiment of FIG. 6, to which air circulation openings have been added.

With regard to the construction of pipe connections 8, 9, the embodiment shown in FIGS. 6 to 8 differs from the embodiment in FIGS. 1 to 5 in that, in the embodiments shown in FIGS. 6 to 8, to begin with, pipe connection 9' is permanently attached to pipe section 14' by pressing, soldering, brazing, welding, or the like. Thus, a special pipe connection 9' is provided here (a screw pipe threaded-type pipe connection being shown) which is especially suitable for high pressure range use of such a valve pistol. This pipe connection 9', from a production engineering viewpoint, can be attached, to begin with, to continuous angular pipe 13'. However, even with such a pipe connection 9', in addition, provision is made for holding in the valve insert unit. In particular, this can easily be achieved in the embodiment shown here by the provision of an interior thread, inward of pipe connection 9' to which an external thread of the insert unit containing valve 17 can be screwed. Alternatively, the valve unit can merely be inserted and be pressure sealed by gaskets and prevented from slipping out, in a way similar to that shown in FIG. 2, by the connection of the feed pipe.

In the embodiment shown in FIGS. 6 to 8, it is significant that valve 17 is located very close to pipe connection 9' which, for its part, projects downward a little out of pistol casing 10'. In other words, valve 17 is thus located here coaxially in pipe section 14' on the lower end of handle section 7' of pistol casing 10'. As with the embodiment of FIG. 1, here, actuation element 24 also projects into the free space formed directly above valve 17 by indentation 19'. This position of valve 17 means that valve 17 is especially easy to exchange. In addition, this position of valve 17 corresponds, in a particularly suitable way, to a special arrangement of hand lever 11' in pistol casing 10' to be explained further below.

With regard to the structure and arrangement of hand lever 11, in the embodiment according to FIGS. 1 to 5, a safety lever 30, which is supported in pistol casing 10 and has spring action, runs through hand lever 11 in the area of an opening slot 37. Further, safety lever 30 acts by its own spring and is supported in pistol casing 10 to pivot around a rotational axis 36 against the spring power. Safety lever 30 is located, in the embodiment shown here, near the upper end of hand lever 11 and has, on the pressure side of hand lever 11, a push button 38, with whose help it can be rotated against the action of its spring around rotational axis 36. On the other side of hand lever 11, safety lever 30 is provided with a bulge 39 on which a stop edge 40 is formed, and against which hand lever 11 lies adjacent in its nonactuated, safety position.

In order to actuate the hand lever 11, first, push button 38 of safety lever 30 is pressed so that it moves upward within opening slot 37 (as shown in phantom lines in FIG. 1). Thus, hand lever 11 is released from stop edge 40 so that it can now be pushed. Thereafter, it is possible to open and close valve 17 without activating safety lever 30 because, in the operating range of valve 17, occurring between the dot-dash line positions of lever 11 in FIG. 1, bulge 39 is braced against hand lever 11 in the area of opening slot 37. Valve 17 is already closed when hand lever 11 is in the middle position, but safety lever 30 is still tilted out of its safety position. Only after hand lever 11 is completely released does a special pressure spring 52, seen higher up in pistol casing 10, cause hand lever 11 to be further pivoted into its resting position, at which safety lever 30 snaps back into its safety position, thereby preventing inadvertent reactuation of the valve pistol by hand lever 11.

Limit stop 53 on hoop guard 31, explained in this construction, has another special function pertaining to safety lever 30. Specifically, in the safety position, i.e., in the rest position of hand lever 11 with the hand lever lying against limit stop 53, as explained above, the distance between limit stop 53 and push button 38 is smaller than a normal width of an adult hand and is smaller than the free surface of hand lever 11 in the middle, closed valve and working, opened valve positions shown in dot-dash line. In this way, an adult hand of normal width can, by slipping into the free space between limit stop 53 and push button 38, so-to-speak, immediately and automatically actuate push button 38 and, thus, release hand lever 11 from the safety position. To the contrary, a child's hand, which is correspondingly narrower, will not automatically release lever 11. In the released safety position, hand lever 11 is prevented from reaching the safety position by the hand of an operator so that safety lever 30 cannot unintentionally be engaged.

In the embodiment of a valve pistol according to the invention shown in FIGS. 1 to 5, rotational axis 29 of hand lever 11 is in a position that is kinematically quite favorable, being located above and in the immediate vicinity of the actuation end of actuation element 24. Hand lever 11 is curved so as to be guided past pipe section 15 into handle section 7 or into hoop guard 31 and has a relatively large lever arm for actuation. The lever arm, which the index finger of the hand of an operator has is, however, considerably shorter than the lever arm that the middle finger, ring finger, or small finger of an operator's hand has. But this is exactly the way it is with all previously known valve pistols, which work with hand lever 11 actuated by one of the fingers of an operator's hand.

In the further, preferred embodiment of the invention shown in FIGS. 6 to 8, with regard to hand lever 11' and handle section 7' of pistol casing 10', in a way that corresponds to FIGS. 1 to 5, hand lever 11' extends approximately parallel to handle section 7' from the lower end on the connection side of handle section 7' (the angle of hand lever 11' relative to handle section 7' changes, of course, when hand lever 11 is actuated). However, in the case of FIGS. 6 to 8, the lower end of lever 11' is connected by a pivot pin 60 to handle section 7', and it extends to the upper end of handle section 7' where lever 11' is close to the bend in pipe 13'. This leads to the fact that, with an otherwise similar handling of the valve pistol, now the index finger of an operator's hand has the largest lever arm and, in the final analysis, the small finger of an operator's hand has the smallest lever arm on hand lever 11'. Ergonomically, this is a perfect solution since, with the index finger and the middle finger of an operator's hand, the greatest exertion of force can result, as a rule. As a result, this simple structural measure facilitates a drastic improvement in the handling technique of the valve pistol in that, in fact, now, without further changes, the valve pistol can be handled with considerably less fatigue.

By placement of valve 17, as explained in detail above, an especially advantageous coaction with the mounting of hand lever 11' to rotate around a rotational axis 60 placed on the lower end of handle section 7' results. That is, hand lever 11' can engage actuation element 24 of valve 17 near rotational axis 60. As shown in FIG. 5, hand lever 11' has a relatively short, radially projecting actuation catch that is formed laterally in close proximity to pivot pin 60 and which engages directly on the free end of actuation element 24. Thus, without special structural measures, an excellent transmission ratio is achieved with a structurally surprising simplicity of arrangement.

When hand lever 11, 11' is constructed to be especially light, for production engineering and cost reasons, it is advisable to provide for a special guide for the hand lever in pistol casing 10, 10'. This can be achieved by the side walls of opening slot 37 in FIG. 1, but in the embodiment according to FIGS. 6 to 8, in particular, hand lever 11' has a curved guide slot 62 on the upper end thereof which interacts with a guide element 61 on pistol casing 10'.

As can be seen, especially in FIG. 7, hand lever 11' is constructed to be relatively wide. So that hand lever 11' can safely be constructed of plastic and be sufficiently rigid, hand lever 11', at least in the area near the upper end, is constructed in cross section and in a plane that includes rotational axis 60 as a double lever by, preferably, being somewhat U-shaped with the U opened toward pipe section 14'. Furthermore, in the position where lever 11' is pivoted toward handle section 7', it enters pistol casing 10' and the U shape straddles pipe section 14', one leg of the U shape being disposed at each side of pipe section 14'. This pivotal position is indicated in FIG. 7 by the broken line representation of hand lever 11'.

When using hot water as the flowing medium, despite the use of heat insulating material for the pistol casing 10, the handle section may heat up to a relatively great extent during lengthy work with the valve pistol. This is uncomfortable from a handling standpoint and is undesirable from a safety engineering viewpoint, but has been accepted as unavoidable up to now since, in this area, the heat discharge toward the outside is naturally especially poor. According to the invention, a remedy is now provided in this respect in that pipe sections 14, 14' and 15, 15' are placed in pistol casing 10, 10' at a distance from the walls. Additionally, preferably, pipe connection 9' is placed on the lower end of handle section 7' in an extension piece 65 of pistol casing 10', enabling an especially good heat insulation to be achieved in handle section 7', since a direct contact of metal and plastic, which is necessarily present in the area of pipe connection 9', is, in any case, not present in the area of handle section 7' that is normally gripped by the hand of an operator.

In addition, it is especially advantageous, from a thermal engineering viewpoint, if pistol casing 10 is provided with air circulation openings 63, 64 (FIG. 8), and FIG. 7 makes it clear that the inner space of pistol casing 10' makes possible an air flow between openings 63, 64 for cooling purposes. Openings 63, 64 are placed, in an especially suitable way, on the lower and upper ends of handle section 7', producing a sort of chimney effect in handle section 7' of pistol casing 10' and, thus, a very highly effective cooling effect. The arrangement of openings 63 in extension piece 65 guarantees that these openings 63 are not unintentionally covered by an operator's hand.

It should be appreciated that various aspects of one embodiment are usable on the other, and vice versa. For example, connection 9, like connection 9', can be located in a bottom extension piece, and casing 10 may be provided with circulation openings 63, 64. Likewise, the pistol of FIGS. 6–8 could utilize the quarter turn bayonet-type lance attachment technique described relative to FIGS. 1–5. Accordingly, since these or other changes and modifications will be apparent to those of ordinary skill in the art, the invention should not be viewed as limited to the specific features of the disclosed embodiments, but rather is intended to encompass all such variations and modifications as are covered by the scope of the appended claims.

I claim:

1. Valve pistol for a high pressure cleaning device with a pistol casing, a valve with a stopper element placed in said pistol casing, a pipe with an obtuse angle bend placed in the pistol casing and having a section used for fluid supply to said valve and a section used for fluid discharge from said valve, sand a hand lever pivotally supported in said pistol casing and acting on the stopper element of said valve; wherein said pipe, including said pipe sections, is formed of a one piece, continuous angular tube; wherein said valve is disposed within the fluid supply section of said tube; and wherein said fluid supply section within which the valve is disposed is provided with an opening through which an actuation element for the stopper element of the valve passes; wherein said pipe has an area of decreased cross section bordering said valve; wherein the opening through which said actuation element passes is located in said area of decreased cross section and facing said valve; and wherein a part of said actuation element is located in a free space created by the area of decreased cross section.

2. Valve pistol according to claim 1, wherein the valve is constructed as an insert unit that is inserted from one end of the fluid supply pipe section; wherein said actuation element extends from the insert body, completely through said opening in the pipe or from outside the pipe through the opening into the insert body.

3. Valve pistol according to claim 1, wherein said area of decreased cross section is formed by an indentation in said pipe at an outer side of the obtuse angle bend of said pipe; wherein the opening through which the actuation element passes is an end wall of said indentation; wherein said valve is disposed in the vicinity of a pipe connection for an external feed pipe; and wherein said pipe connection is on an opposite side of said valve relative to said indentation.

4. Valve pistol according to claim 1, wherein said area of decreased cross section is formed by an indentation in said pipe; wherein the opening through which the actuation element passes is a wall of said indentation in proximity to said valve; and wherein a pipe connection for an external feed pipe is disposed in the vicinity of said valve at an opposite side thereof from said indentation.

5. Valve pistol according to claim 1, wherein the hand lever, at least in an upper end area, is of an approximately U-shaped cross section in a plane that includes said rotational axis, wherein said U shape opens toward the fluid supply pipe section and, in a position tilted toward the handle section, laterally straddles the fluid supply pipe section.

6. Valve pistol according to claim 2, wherein said area of decreased cross section is formed by an indentation in said pipe; wherein the opening through which the actuation element passes is a wall of said indentation in proximity to said valve; and wherein a pipe connection for an external feed pipe is disposed in the vicinity of said valve at an opposite side thereof from said indentation.

7. Valve pistol for a high pressure cleaning device with a pistol casing, a valve with a stopper element placed in said pistol casing, a pipe with an obtuse angle bend placed in the pistol casing and having a section used for fluid supply to said valve and a section used for fluid discharge from said valve, and a hand lever pivotally supported in said pistol casing and acting on the stopper element of said valve; wherein said valve is disposed within one of said pipe sections; wherein the pipe section within which the valve is disposed is provided with an opening through which an actuation element for the stopper element of the valve passes; wherein said fluid supply pipe section has a pipe connection for connection to an external feed pipe; wherein the fluid supply pipe section is widened in steps to form said pipe connection; wherein a connection piece that is permanently attached to said external feed pipe is inserted within the fluid supply pipe section; and wherein said valve is held stationarily in said pipe section by said connection piece.

8. Valve pistol according to claim 7, wherein said connection piece has an annular slot; wherein said fluid supply pipe section has an insert slot aligned with said annular slot, and wherein an approximately U-shaped clamp has legs of the U-shape inserted through an insertion opening in the pistol casing into said insert slot and annular slot.

9. Valve pistol according to claim 8, wherein said clamp has a widened head area and said head area completely closes the insertion opening when the clamp is inserted.

10. Valve pistol according to claim 7, wherein said pipe connection for an external feed pipe is recessed within the interior of the pistol casing; and wherein the pistol casing has a slide-in guide for an end of the external feed pipe.

11. Valve pistol according to claim 7 wherein said pipe, including said pipe sections, is formed of a one piece, continuous angular tube.

12. Valve pistol for a high pressure cleaning device with a pistol casing, a valve with a stopper element placed in said pistol casing, a pipe with an obtuse angle bend placed in the pistol casing and having a section used for fluid supply to said valve and a section used for fluid discharge from said valve, and a hand lever pivotally supported in said pistol casing and acting on the stopper element of said valve; wherein said valve is disposed within one of said pipe sections; wherein the pipe section within which the valve is disposed is provided with an opening through which an actuation element for the stopper element of the valve passes; wherein the fluid discharge pipe section has a pipe connection for connecting an external spray lance or the like; wherein the fluid discharge pipe section is widened in steps; wherein the fluid discharge pipe section is provided with an indentation part of a quarter turn catch; wherein said spray lance is provided with a catch pin counterpart of the quarter turn catch for engagement with said indentation part; wherein an axially braced pressure spring is disposed in the fluid discharge pipe section; wherein an end of the spray lance has a connecting piece for engaging said pressure spring and for sealing said lance relative to said fluid discharge pipe section via gasket rings mounted in annular slots formed in at least one of said connecting piece, said lance and said fluid discharge pipe section.

13. A valve pistol according to claim 12, wherein said connecting piece has an annular slot into which an end of the spray lance is rolled for attachment thereof to said connecting piece.

14. Valve pistol according to claim 12 wherein said pipe, including said pipe sections, is formed of a one piece continuous angular tube.

15. Valve pistol for a high pressure cleaning device with a pistol casing, a valve with a stopper element placed in said pistol casing, a pipe with an obtuse angle bend placed in the pistol casing and having a section used for fluid supply to said valve and a section used for fluid discharge from said valve, and hand lever pivotally supported in said pistol casing and acting on the stopper element of said valve; wherein said valve is disposed within one of said pipe sections; wherein the pipe section within which the valve is disposed is provided with an opening through which an actuation element for the stopper element of the valve passes; wherein the hand lever has an opening slot which is penetrated by a safety lever that is supported in the pistol casing and acted on by a spring; wherein said hand lever is held by a stop edge of the safety lever, in a safety position, when released; wherein said safety lever has a push button for pivoting said safety lever out of said safety position; wherein a limit stop is formed on a hoop guard of the pistol casing that surrounds the hand lever in the vicinity of a lower end thereof; and wherein the distance from the limit stop to the push button, when the safety lever is in said safety position and said hand lever is released, is smaller than a typical width of an adult hand and is smaller than a grippable length of the hand lever in a depressed working position thereof with said safety lever out of said safety position.

16. Valve pistol according to claim 15 wherein said pipe, including said pipe sections, is formed of a one piece, continuous angular tube.

17. Valve pistol for a high pressure cleaning device with a pistol casing, a valve with a stopper element placed in said pistol casing, a pipe placed in the pistol casing and having a section used for fluid supply to said valve and a section used for fluid discharge from said valve, and a hand lever pivotally supported in said pistol casing and acting on an actuation element for the stopper element of said valve; wherein said valve is disposed within said pipe and said pipe is provided with an opening through which said actuation element passes; wherein said pistol casing has a handle section that receives said fluid supply pipe section and said hand lever extends approximately parallel to said handle section from a lower end of the handle section toward an upper end of the handle section; wherein the hand lever is pivotally supported for movement around a rotational axis on the lower end of the handle section; wherein said valve is disposed within said fluid supply pipe section, said actuation element for said stopper element of said valve being positioned adjacent to said rotational axis; wherein said valve is constructed as an insert unit that is inserted from one end of said fluid supply pipe section; wherein said actuation element extends from the insert body, completely through said opening in the pipe; wherein said hand lever engages said actuation element of the valve near said rotational axis; wherein said pipe has an area of decreased cross section bordering said valve; wherein the opening through which said actuation element passes is located in said area of decreased cross section and faces said valve; and wherein a part of said actuation element is located in a free space created by the area of decreased cross section.

18. Valve pistol according to claim 17, wherein said area of decreased cross section is formed by an indentation in said pipe; wherein the opening through which the actuation element passes is a wall of said indentation in the proximity of said valve; and wherein a pipe connection for an external feed pipe is disposed in the vicinity of said valve at an opposite side thereof from said indentation.

19. Valve pistol for a high pressure cleaning device with a pistol casing, a valve with a stopper element placed in said pistol casing, a pipe placed in the pistol casing and having a section used for fluid supply to said valve and a section used for fluid discharge from said valve, and a hand lever pivotally supported in said pistol casing and acting on an actuation element for the stopper element of said valve; wherein said valve is disposed within said pipe and said pipe is provided with an opening through which said actuation element passes; wherein said pistol casing has a handle section that receives said fluid supply pipe section and said hand lever extends approximately parallel to said handle section from a lower end of the handle section toward an upper end of the handle section; wherein the hand lever is pivotally supported for movement around a rotational axis on the lower end of the handle section; wherein said valve is disposed within said fluid supply pipe section, said actuation element for said stopper element of said valve being positioned adjacent to said rotational axis; wherein said valve is constructed as an insert unit that is inserted from one end of said fluid supply pipe section; wherein said actuation element extends from outside the pipe through the opening into the insert body; wherein said hand lever engages said actuation element of the valve near said rotational axis; wherein said pipe has an area of decreased cross section bordering said valve; wherein the opening through which said actuation element passes is located in said area of decreased cross section and faces said valve; and wherein a part of said actuation element is located in a free space created by the area of decreased cross section.

20. Valve pistol according to claim 19, wherein said area of decreased cross section is formed by an indentation in said pipe; wherein the opening through which the actuation element passes is a wall of said indentation in the proximity of said valve; and wherein a pipe connection for an external feed pipe is disposed in the vicinity of said valve at an opposite side thereof from said indentation.

* * * * *